US009725784B2

(12) United States Patent
McHugh et al.

(10) Patent No.: US 9,725,784 B2
(45) Date of Patent: Aug. 8, 2017

(54) PRODUCTION OF COPPER VIA LOOPING OXIDATION PROCESS

(71) Applicants: Lawrence F. McHugh, North Andover, MA (US); Leonid N Shekhter, Ashland, MA (US); Joseph D. Lessard, Medford, ME (US); Daniel G. Gribbin, Portland, ME (US); Esra Cankaya-Yalcin, North Andover, MA (US)

(72) Inventors: Lawrence F. McHugh, North Andover, MA (US); Leonid N Shekhter, Ashland, MA (US); Joseph D. Lessard, Medford, ME (US); Daniel G. Gribbin, Portland, ME (US); Esra Cankaya-Yalcin, North Andover, MA (US)

( * ) Notice: Subject to any disclaimer, the term of this patent is extended or adjusted under 35 U.S.C. 154(b) by 647 days.

(21) Appl. No.: 13/922,505

(22) Filed: Jun. 20, 2013

(65) Prior Publication Data

US 2013/0340568 A1 Dec. 26, 2013

Related U.S. Application Data

(60) Provisional application No. 61/662,603, filed on Jun. 21, 2012, provisional application No. 61/690,210, filed on Jun. 21, 2012.

(51) Int. Cl.
*C22B 15/00* (2006.01)

(52) U.S. Cl.
CPC ..... *C22B 15/0052* (2013.01)

(58) Field of Classification Search
CPC ..... C22B 15/0052
USPC ..... 75/10.14, 640, 643, 10.62
See application file for complete search history.

(56) References Cited

U.S. PATENT DOCUMENTS

| | | | | |
|---|---|---|---|---|
| 2,506,557 A | | 6/1947 | Bryk et al. | |
| 2,668,107 A | | 2/1954 | Gordon et al. | |
| 3,212,883 A | * | 10/1965 | McFarland | C22B 15/0023 423/32 |
| 3,281,236 A | * | 10/1966 | Meissner | C22B 15/006 75/643 |

(Continued)

FOREIGN PATENT DOCUMENTS

| | | | |
|---|---|---|---|
| EP | 0648849 | B2 | 7/2004 |
| GB | 18898 | A1 | 0/1890 |
| WO | 2008130649 | A1 | 10/2008 |

OTHER PUBLICATIONS

Kettner, P., et al., The "Brixlegg Electro-Smelting Process" Applied to Copper Concentrates, 1972, p. 26, AIME-Tagung San Francisco.

(Continued)

*Primary Examiner* — Jie Yang
(74) *Attorney, Agent, or Firm* — Inna Y. Belopolsky, Esq

(57) ABSTRACT

Copper is produced by a looping oxidizing process wherein oxidation of copper sulfide concentrate to molten blister copper by conversion with copper oxides (and optionally oxygen from air) in a one step, molten bath operation to produce molten blister copper, iron oxide slag, and rich $SO_2$ off gas. The blister copper is treated in an anode furnace to reduce the iron content and oxidize residual sulfur, and prepare it for either electrolysis or reoxidation.

37 Claims, 12 Drawing Sheets

(56) References Cited

U.S. PATENT DOCUMENTS

| | | | | |
|---|---|---|---|---|
| 3,589,892 | A * | 6/1971 | Peterson et al. | C22B 5/00 75/363 |
| 3,674,463 | A | 7/1972 | Yannopoulos | |
| 3,790,366 | A | 2/1974 | Bryk et al. | |
| 3,799,764 | A | 3/1974 | Opie et al. | |
| 3,892,560 | A | 7/1975 | Nermes et al. | |
| 3,905,807 | A | 9/1975 | Floyd | |
| 3,948,639 | A | 4/1976 | Nermes et al. | |
| 4,005,856 | A | 2/1977 | Themelis et al. | |
| 4,006,010 | A | 2/1977 | Rajcevic et al. | |
| 4,072,507 | A | 2/1978 | Rajcevic et al. | |
| 4,251,245 | A | 2/1981 | Reynolds | |
| 4,251,271 | A | 2/1981 | Floyd | |
| 4,252,560 | A | 2/1981 | Vanjukov et al. | |
| 4,294,433 | A | 10/1981 | Vanjukov et al. | |
| 4,470,845 | A | 9/1984 | Yannopoulos | |
| 4,504,309 | A | 3/1985 | Mackey et al. | |
| 4,552,749 | A | 11/1985 | McHugh et al. | |
| 4,615,729 | A | 10/1986 | Victorovich et al. | |
| 5,017,250 | A * | 5/1991 | Ashok | B22D 23/003 148/411 |
| 5,607,495 | A | 3/1997 | Warner | |
| 5,662,730 | A | 9/1997 | Akagi et al. | |
| 6,231,641 | B1 * | 5/2001 | Utigard | C22B 15/003 75/640 |
| 6,699,302 | B1 * | 3/2004 | Jones | C21C 5/5229 75/10.32 |
| 2005/0199095 | A1 | 9/2005 | Hanniala et al. | |
| 2008/0260612 | A1 | 10/2008 | McHugh | |
| 2012/0034154 | A1 | 2/2012 | McHugh et al. | |

OTHER PUBLICATIONS

World Mining, vol. 33, No. 12, Nov. 1980, Dead roast-shaft furnace copper smelting, pp. 40-41.

Opie,W/R, 1981 AMAX Base Metals Research & Development, Inc. , pp. 137-140, Pryometallurgical process that produce blister grade copper without matte smelting.

Bhappu, Ross et al., 1994 EPD Congress, Cyprus Miami Mining Corporation, The Minerals, Metals & Materials Society, 1993, pp. 55-570.

Coursol, P., Mackey, P.J., 2010, Proceedings of Copper 2010, Energy Consumption in Copper Sulphide Smelting, pp. 1-22.

* cited by examiner

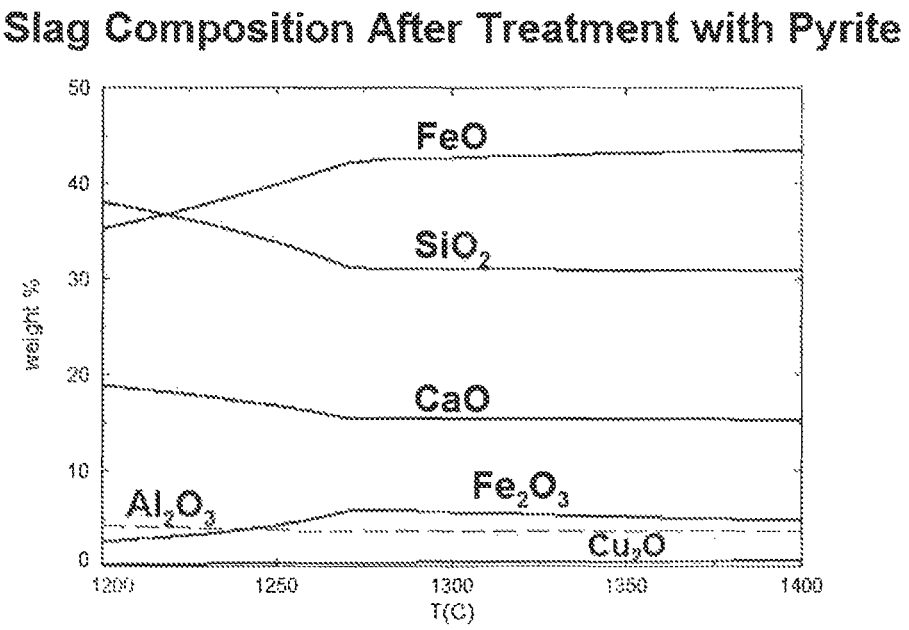
Figure 15. Slag composition after treatment with iron pyrite
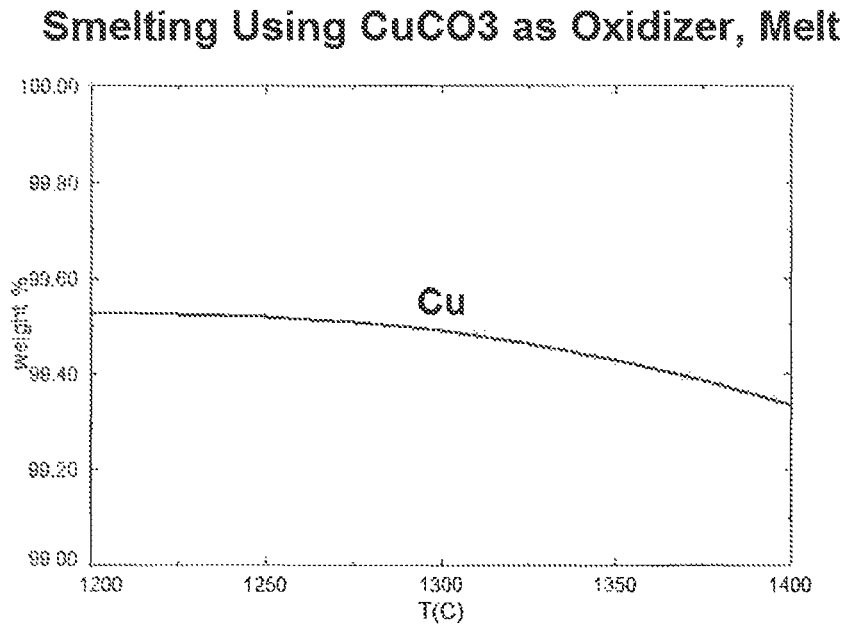
Figure 16.

PRODUCTION OF COPPER VIA LOOPING OXIDATION PROCESS

CROSS-REFERENCE TO RELATED APPLICATIONS AND PUBLICATIONS

This application claims priority from U.S. provisional patent application 61/662,603 and 61/690,210 both filed Jun. 21, 2012. The full content of the said applications and of all other patents, published patent applications and non-patent publications cited herein are incorporated herein by reference as though set out at length herein.

FIELD OF THE INVENTION

The present invention relates to improved methods for production of copper from copper sulfide concentrates produced as part of a mineral ore refining.

BACKGROUND OF THE INVENTION

De Re Metallica by Georgius Agricola, published in 1556, details the mining, smelting, and refining techniques and technologies of that era. Since then the basic chemical reactions to produce copper have not significantly changed, while the modern smelting process now treats a concentrate rather than as-mined ore of that time. However, technology has markedly advanced through numerous changes and improvements to copper smelting methodology since De Re Metallica's publication. The "Welsh" process, based on a series of sequential reverberatory smelting steps, subsequently dominated copper smelting for over a hundred years. In the 1890s, Nicholls and James developed a process (Great Britain Patent 18,898) based on an alternative final step in the traditional "Welsh" copper smelting process. In this invention part of the high-grade white metal stream was diverted for calcination to produce a copper oxide material for subsequent re-use in the oxidation of the main white metal stream to produce metallic copper. The large, fuel-fired reverberatory furnace was later used for concentrate smelting throughout the first three-quarters of the twentieth century. In more modern times, newer flash and bath smelting processes were developed. The flash smelting concept was described by Bryk et al. in U.S. Pat. No. 2,506,557. Later, Gordon et al described a variant of the flash smelting process in U.S. Pat. No. 2,668,107. An alternative to flash smelting is the bath smelting process such as introduced by McKerrow et al. in U.S. Pat. No. 4,005,856 and also Bailey et al. in U.S. Pat. No. 4,504,309. Still another bath smelting approach, referred to as the Isasmelt process, based on a top lance blowing system with the particular lance system described by Floyd in U.S. Pat. Nos. 3,905,807 and 4,251,271, was developed. The lance system is used in the process operating in Arizona as described by Bhappu et al in: EPD Congress 1994, Edited by G. Warren, The Minerals, Metals and Materials Society, 1993, pages 555 to 570. Each of the contemporary processes described above for the modern era produce a medium to high-grade of copper matte which is typically processed in Peirce-Smith converters to blister copper. Following this, the produced copper is transferred to an anode furnace (European Patent 0648849 B2) for finishing to anode copper for subsequent casting and thence to electrolytic refining. The conventional flash furnace and converter process flow sheet is depicted in FIG. 1. As shown here, copper concentrate is introduced into the flash smelting furnace (as an example of a modern smelting unit) where the copper sulfide concentrate react with oxygen-enriched air to form a medium grade of matte and a slag. The reaction in the flash furnace can be represented by the following equation (Equation 1). Some nitrogen will also be present with the oxygen, depending on the degree of oxygen enrichment.

$$2CuFeS_2 + \frac{13}{4}O_2 = Cu_2S + \frac{1}{2}FeS + \frac{3}{2}FeO + \frac{5}{2}SO_2 \Delta H^o = -250 \text{ Wh} \quad (1)$$

A fossil fuel may be used as a supplementary energy source as required for heating/sustaining typical flash temperatures above 1350° C. A silica flux is added during this step to flux with the iron oxide product shown in Equation (1). The resulting flash furnace slag is sent to a slag treatment facility for copper recovery. The process off-gases are first cleaned and are then treated in a sulfuric acid plant for sulfur recovery.

The remaining molten white metal is transferred to a converter, where it is blasted with oxygen-enriched air to remove remaining sulfides, produce the blister copper, and form an additional slag (Equations 2 and 3).

$$Cu_2S+O_2=2Cu+SO_2 \ \Delta H^\circ=-59 \text{ Wh} \quad (2)$$

$$FeS+1.5O_2=FeO+SO_2 \ \Delta H^\circ=-130 \text{ Wh} \quad (3)$$

The converter slag is typically higher in copper content, and also requires slag treatment. The flue gases from this step also require processing in the sulfuric acid plant. The copper melt is sent to anode casting (often proceeded by an anode furnace to further purify the copper metal) and then on to electrolysis.

In total, this flash process has gained wide-spread acceptance in the copper industry. Its advantages over older reverberatory molten bath smelting are manifold: utilization of the heat released during oxidation of sulfides with oxygen, high furnace throughput, high copper recovery into matte, and higher $SO_2$ content in the off gas relative to the molten bath process. However, and as previously mentioned, significant control must be maintained throughout the process and significant opportunities for improvement exist. Principally, the composition of the feed materials must be well specified, an understanding of the absolute and relative particle sizes is required, moisture and sulfide contents of the concentrates and fluxes must be quantitatively known, and furnace dimensions and temperatures are critical. Precise control over the feed ratios and rate of oxygen injection must be maintained. Similarly, the amount of siliceous flux that must be added is wholly dependent on the sulfide concentrate and the amount of iron that must be oxidized; high copper losses into the slag are still observed and this requires a separate treatment step. The energy demands of the flash process require preheating of the furnace to circa 900-1100° C. to initiate the exothermic reactions involved when oxygen enrichment is not used. This high temperature conversion leads to NO, formation. Oxygen-enriched air is normally used, in which case preheating the air is not common.

Several variations on flash smelting technology have been developed since the Gordon et al. first work. U.S. Pat. Nos. 5,662,730; 3,790,366; 3,948,639; 3,892,560; 4,615,729; 4,470,845; 3,674,463; 5,607,495; 4,521,245; and US Published Patent Application 2005/0199095 demonstrate oxygen enrichment of air, various techniques for copper recovery from slags as well as partial or dead roasting of the sulfide concentrate prior to flash smelting.

Work performed in the 1890s by Thomas Davies Nicholls, et al. (Great Britain patent 18,898) details the use of copper oxides in roasting copper mattes to copper metal. During this time period, pneumatic copper converting was just in its infancy, hence this method was considered an improvement over the established contemporary roasting process. Copper (I) sulfide, previously smelted into matte (76-78% copper), is crushed and melted in a reverberatory furnace common at that time with calcined copper. The produced copper was then poled to produce a final copper. In this process, it was difficult to produce CuO during the calcination of Cu metal, so $Cu_2O$ was used. Production of copper anodes from copper sulfide sources without producing an intermediate copper matte phase has been performed and summarized in the literature[1,2]. In such operations, the copper sulfide concentrate is first dead roasted at elevated temperatures (900° C.) in an excess of oxygen to produce a copper calcine with sulfur levels around 2% (generally 1-1.5% sulfur). The calcine is then transferred to an electric furnace (e.g. the Brixlegg Process)[3,4], a segregation furnaces[5,6], a rotary furnace[7], or a shaft furnace[8,9] where it is further converted to produce blister copper, slag and $SO_2$ off gases.

[1]Opie W R, (1981) Pyrometallurgical processes that produce blister grade copper without matte smelting. IMM, 137-140.

[2](1980) Dead Roast-Shaft Furnace copper smelting, World Mining, Vol 33, Issue 12, 40-41.

[3]Kettner P, Maelzer C A, and Schwartz W H, (1972) The Brixlegg Electro-Smelting Process Applied to Copper Concentrates, AIME Annual Meeting, San Francisco.

[4]Paulson D L, Worthington R B, and Hunter W L, (1976) Production of Blister Copper by Electric Furnace Smelting of Dead-Burned Copper Sulfide Concentrates, U.S. Bureau of Mines, RI-8131.

[5]Opie W R, and Coffin L D, (1974) Roasting of Copper Sulfide Concentrates Combined with Solid State Segregation Reduction to Recover Copper, U.S. Pat. No. 3,799,764.

[6]Pinkney E T, and Plint N, (1968) Treatment of Refractory Copper Ores by the Segregation Process, Transactions of AIME, Vol 241, 373-415.

[7]Rajcevic H P, Opie W R, and Cusanelli D C (1978) Production of Blister Copper in a Rotary Furnace from Calcined Copper-Iron Concentrates, U.S. Pat. No. 4,072,507.

[8]Rajcevic H P, Opie W R, and Cusanelli D C (1977) Production of Blister Copper Directly from Dead Roasted-Copper-Iron Concentrates Using a Shallow Bed Reactor, U.S. Pat. No. 4,006,010.

[9]Opie W R, Rajcevic H P, Querijero E R, (1979) Dead Roasting and Blast-Furnace Smelting of Chalcopyrite Concentrates, Journal of Metals, Vol 31, Issue 7, 17-22.

It is an object of the present invention to provide a better method to recover copper from copper sulfide concentrates via a process chemistry previously unused by the copper smelting industry. This process is referred to as the "Looping Sulfide Oxidation" (or "LSO") process.

SUMMARY OF THE INVENTION

Many of the opportunities for improvement in flash smelting outlined above stem from the incremental removal of sulfur in two separate processing steps. As a result, the concentrations of the $SO_2$ streams, which while higher than the concentrations in the roaster and reverberatory furnace off gases (ca. 15-20% $SO_2$), the presence of two sulfurous off gas streams requires handling and treatment, and slags with relatively high copper contents are produced in both the flash furnace and the converter. The Looping Sulfide Oxidation process for copper production removes sulfur in a single step while using copper oxides ($Cu_2O$ and CuO) as oxidizing agents to either replace or augment oxygen ($O_2$) from natural air without producing a matte phase. Reference herein to copper oxide oxidizing agents include copper carbonates, sulfates and other oxygen containing copper compounds thermodynamically suitable for use in the Looping Sulfide Oxidation process following the guidelines shown in this application.

Looping Sulfide Oxidation features three distinct steps: conversion of the copper sulfide concentrates into copper and copper oxides (wholesale desulfurization), recovery of copper from the slag, and looping oxide regeneration (FIG. 2). This process primarily uses CuO as the oxidizing agent instead of $O_2$ in order to eliminate oxygen-enriched air utilization in the sulfur removal step and to generate energy from the reoxidation of copper downstream. Looping Sulfide Oxidation allows for greater energy capture by performing all the desulfurization of concentrates in a single step. Metal refining and slag treatment are handled simultaneously in the second step. Overall copper yield matches well with recovery levels achieved in the conventional flash process.

In this first step of the Looping Sulfide Oxidation process, the copper concentrate is blended with fluxes and the oxidizing agent, CuO. In alternative embodiments, the CuO may be augmented with oxygen from air in a fashion such that the total stoichiometry of the system is maintained. The reaction that takes place in this furnace is presented below.

$$CuFeS_2 + aCuO + \left(\frac{5-a}{2}\right)O_2 \rightarrow (1+a)Cu + FeO + 2SO_2 \quad (4)$$

In such a reaction scheme, the value of a is allowed to vary such that ratio of CuO to $O_2$ might range from 5:0 to minimal CuO with greater portions of $O_2$ while still satisfying the reaction stoichiometry. While the relative ratio of CuO and $O_2$ is important, the total amount of oxidizer may be equal to or in excess of the amount required to completely oxidize the copper concentrate. Consideration must be made that excess of the oxidizer can influence the copper melt and/or slag compositions. In this sense, CuO functions to oxidize the iron in the concentrate and/or slag in addition to oxidizing (desulfurizing) the copper in the concentrate. A fraction of copper will be present in the slag as $Cu_2O$ due to the equilibrium established between the slag and the copper metal phase. As such, the calculated stoichiometry of the oxidizing agents is minimal, and will be exceeded.

One possible embodiment of the furnace is a Vanyukov-type furnace[10,11] (exemplars of which appear in U.S. Pat. Nos. 4,252,560 and 4,294,433), i.e. the concentrate and fluxes are added through the slag, which is agitated by the injection of $N_2$, hot combustion products, and/or air through tuyères; additionally, the energy is supplied via electrodes submerged in the slag. Due to the high energy demand of the endothermic reaction that takes place, additional heat must be provided to the first furnace. This heat will be supplied either solely through the electrical heating of the furnace or through electrical heating augmented by combustion of fuels, whose heat will be transmitted to the furnace through the hot gases in the tuyères and whose chemically inert combustion product gases will be injected into the molten slag to facilitate mixing. Another embodiment may use a top-blown lance in the slag in an Isasmelt-type furnace; this embodiment may also include electrode heating.

[10]Bystov, V P, Fyodorov, A N, Komkov A A, and Sorokin M L (1992) The use of the Vanyukov process for the smelting of various charges, in *Extractive Metallurgy of Gold and Base Metals*, Australasian Institute of Mines and Metallurgy, Pardville, Vic., 477-482.

[11]Bystrov, V P, Komkov A A, and Smimov L A (1995) Optimizing the Vanyukov process and furnace for treatment of complex copper charges, in *Copper 95-Cobre 95, Vol. IV—Pyrometallurgy of Copper*, ed. Chen W J, Diaz C, Luraschi A, and Mackey P J, The Metallurgical Society of CIM, Montreal, Canada, 167-178.

The process chemistry that takes place in the first furnace is of critical importance. Most notably, metal not matte is formed during this step. This marks a significant differentiation and improvement over the present state of the art. The molten copper metal produced in the furnace is very low in iron and is sent directly to the anode furnace. The oxidized iron slag contains copper that must be recovered during slag treatment. As previously mentioned, the complete desulfurization of the concentrate is accomplished in this single step. This allows for significant energy capture during sulfuric acid production in an acid plant. Additionally, because no sulfurous/sulfuric gases will be produced in the downstream processing, aggressive energy capture can be performed on the off gases without fear of acid condensation. The major differences between this invention and the closest prior art (Nicholls et al.) are:

1. The raw material is neither blister copper nor matte, but is rather copper sulfide concentrate
2. The raw material and copper oxide are simultaneously fed into the molten slag in the smelting furnace; the slag is agitated via the injection of combustion product gases or chemically inert gases
3. The use of oxygen is controlled and special care is taken to ensure that the total oxygen from air and copper oxide does not exceed 20% excess of the required stoichiometric amounts.

Slag composition in the smelting step can be further optimized by changing the amounts of fluxes (CaO, $SiO_2$, $Al_2O_3$) added to reduce the viscosity, lower the melting temperature, and increase copper recovery into the copper melt. Increased calcium oxide will decrease the copper solubility in the slag. The amount of $Fe_2O_3$ (i.e. the amount of $Fe^{3+}$) in the slag must be reduced.

During slag treatment, the goal is to recover as much copper as possible from the slag phase so that it can be returned to the processing loop for copper anode production. In general, the slag from the first furnace will contain ca. 10-15% copper in the slag as $Cu_2O$. The slag, which is still molten, is treated with either carbon (from coal or natural gas) to reduce the copper oxides to copper metal (and the trivalent iron to divalent iron), or oxidized with sulfur (e.g., as iron pyrite), to produce copper matte. With carbon reduction the copper from the slag treatment furnace can be mixed with the copper rich material from the smelting furnace; with sulfidation, the matte will be returned to the smelting furnace to be reprocessed.

Slag treatment must reduce the copper content in the waste slag to levels below ca. 0.4 weight percent. The copper solubility in the slag is a function of many variables; one of critical importance is the Fe(III):Fe(II) ratio. In this process, the copper solubility in the slag is reduced (and thereby the copper recovery is increased) by significantly reducing the Fe(III) content in the slag. Additionally, when the product from slag treatment is copper metal, the iron content must be sufficiently low enough for an anode furnace. In the process presented here, the copper metal from the slag treatment step is blended with the copper metal from the first furnace to produce a copper-rich stream to be processed in the anode furnace. If sulfidation is performed, the copper matte produced will be processed in the first furnace. This step in the process is carried out in a traditional slag treatment furnace, e.g. an electric furnace.

The anode furnace operates in the same fashion as conventional anode furnaces. The copper melt is first oxidized to oxidize any residual iron to a dry slag; in this step some of the copper metal may be co-oxidized. The slag is tapped off and the remaining copper melt is then deoxidized prior to casting to anodes ready for electrolytic refining.

The fraction of copper that is sent to electrolysis is determined by the stoichiometry of the reaction in the smelting furnace (i.e. the amount of copper in the concentrate is equal to the amount of copper in the anodes for electrolysis). The necessary amount of copper to produce the requisite copper oxide for oxidation of the copper concentrate is sent to the reoxidation furnace. In this furnace, the copper melt is atomized and oxidized to CuO with air. This highly exothermic reaction can be harnessed for energy capture. The molten copper is oxidized at high temperatures in a downer or vertical furnace (ca. 1500° C.), and cooled below freezing to ca. 800° C. The powdered CuO is then looped back to the smelting furnace to complete the reaction cycle.

$$2Cu+O_2 \rightarrow 2CuO \quad \Delta H_{1500^\circ C.} = -59.5 \text{ Wh} \tag{5}$$

This invention provides an improvement over the closest prior art wherein $Cu_2O$ was produced (Nicholls et al.) in which copper matte is oxidized to produce copper oxide. In this work, copper is reoxidized after atomization to promote rapid and complete oxidation.

Alternatively, other sources of copper oxides can be used as oxygen carriers during Looping Sulfide Oxidation. For example, CuO is used in the industry as pigments in ceramic materials, battery materials and catalysts. These materials can be fed to the smelting furnace to augment the copper oxides that are produced in the reoxidation furnace. Similarly, several copper oxide minerals are processed by the copper industry; these minerals can be used as source of copper oxides during Looping Sulfide Oxidation. Thermodynamic calculations, made with FactSage 6.4[12] thermodynamic software, detailing such operation are disclosed below.

[12]Bale, C. W., et al., FactSage™ 6.4.1, Thermfact and GTT-Technologies, CRCT, Montreal, Canada (2013).

Copper scrap is also an important copper stream for Looping Sulfide Oxidation. Copper scrap metals and copper alloy scrap can be processed in Looping Sulfide Oxidation via either smelting in the smelting furnace in the presence of copper oxides (potentially augmented with air), or via initial oxidation to copper oxides in the reoxidation furnace. In the former embodiment, the copper scrap is melted in the smelting furnace and converted to copper metal in the same fashion as copper concentrate. Depending on the composition of the scrap, alloyed metals will report to either the slag or the copper phase. The use of this embodiment can gain an increase in the iron content in the molten copper due to the reduction of the iron oxides present in the slag with any reducing metals (e.g. aluminum or silicon) present in the scrap. In the latter embodiment, the copper scrap is processed to enable its rapid atomization and oxidation (in one embodiment, in a plasma furnace) to copper oxides that can be looped to the smelting furnace.

Other objects, features and advantages will be apparent from the following detailed description of preferred embodiments taken in conjunction with the accompanying drawings in which:

BRIEF DESCRIPTION OF THE DRAWINGS

FIGS. 9-15 show traces of thermodynamic data detailing the slag treatment and output of the slag treatment furnace, the treated slag and the copper melt or copper matte;

FIGS. 16-19 show traces of thermodynamic data detailing the smelting of $CuFeS_2$ with $CuCO_3$.

DETAILED DESCRIPTION OF PREFERRED EMBODIMENTS

Example 1

Figure 1:
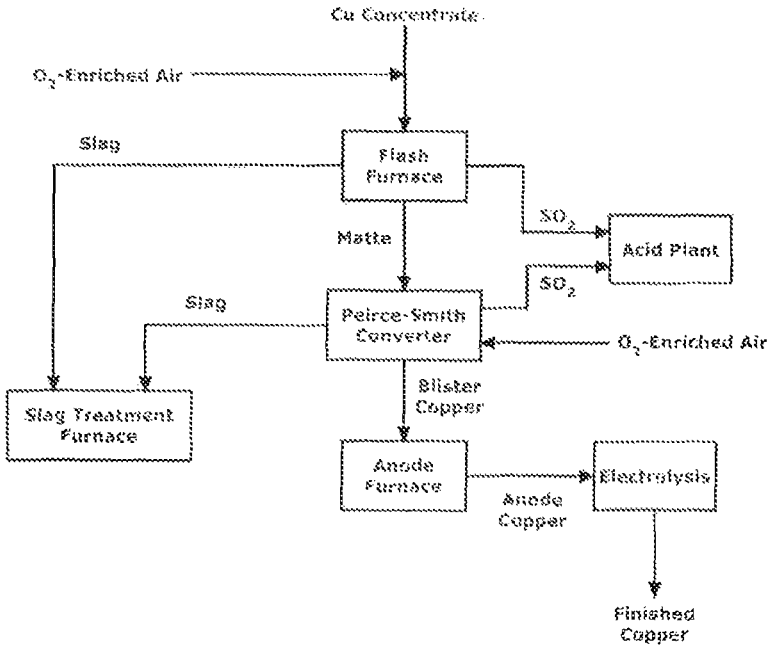
Figure 1. (Prior Art)
FIG. 1 (Prior Art) shows in block diagram form a generalized process flow chart for flash smelting conversion.
Figure 2:
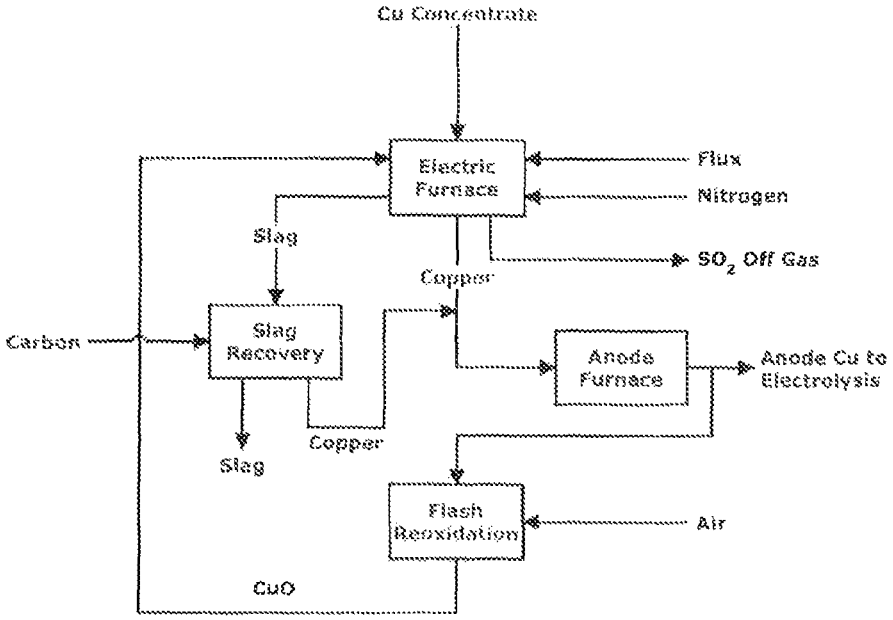
FIG. 2 shows in block diagram form a Looping Sulfide Oxidation Process to produce anode copper.
Figure 2A:
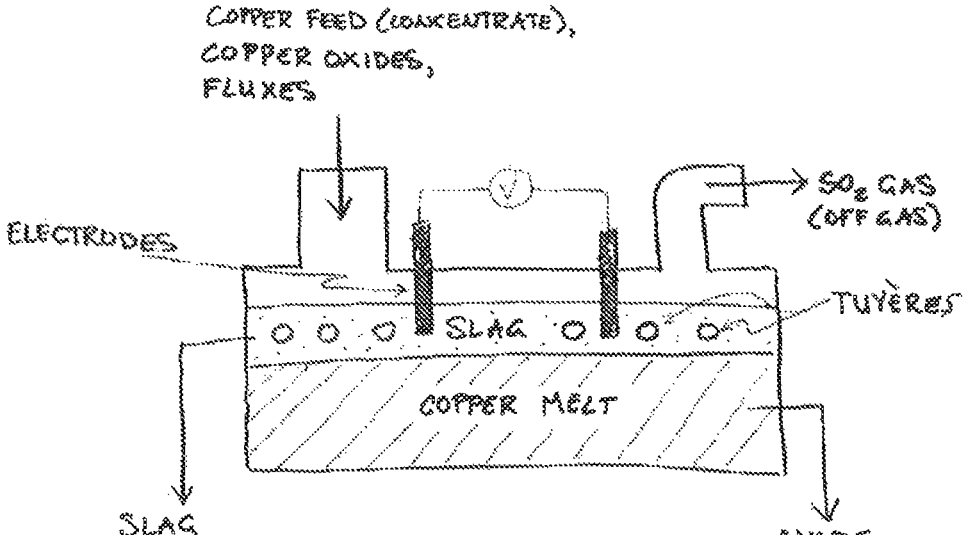
FIG. 2*a* shows schematically an electric arc furnace used in the smelting conversion.

In the present analytical example (not based on a physical plant actually constructed) the process is described on a production basis of approximately 1000 kg of anode copper. The process flow (all or parts of which can be continuous, semi-continuous or batch format) is shown in FIG. 2 and the preferred basic configuration of the electric furnace (an arc furnace) is shown in FIG. 2*a* including tuyères for gas injection into a molten slag formed in the furnace.

Electric Furnace

Figure 3:
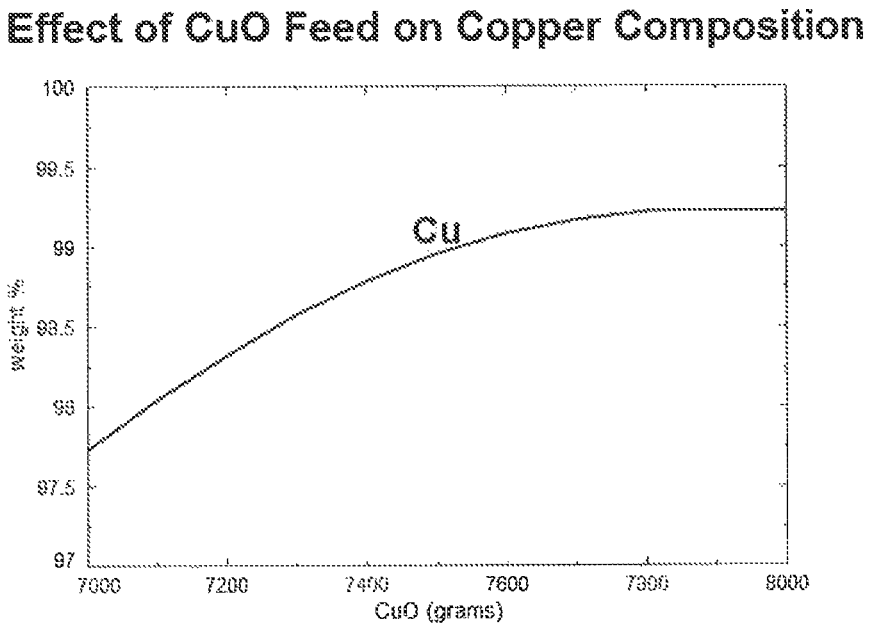
FIGS. 3-8 are traces of thermodynamic data showing calculations of production conditions (CuO) feed variation on output conditions of the copper melt and slag during the smelting step.
Figure 4:
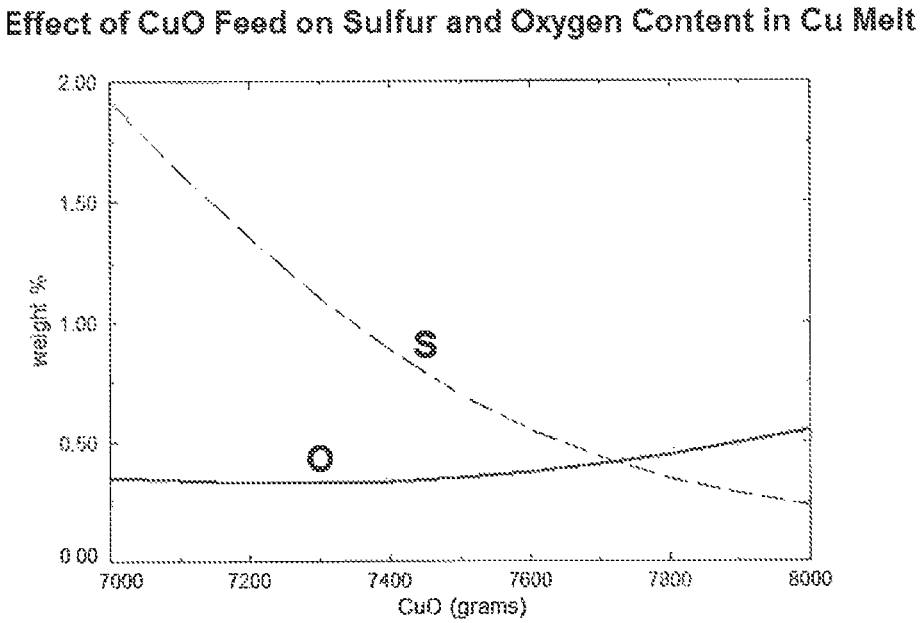
Figure 5:
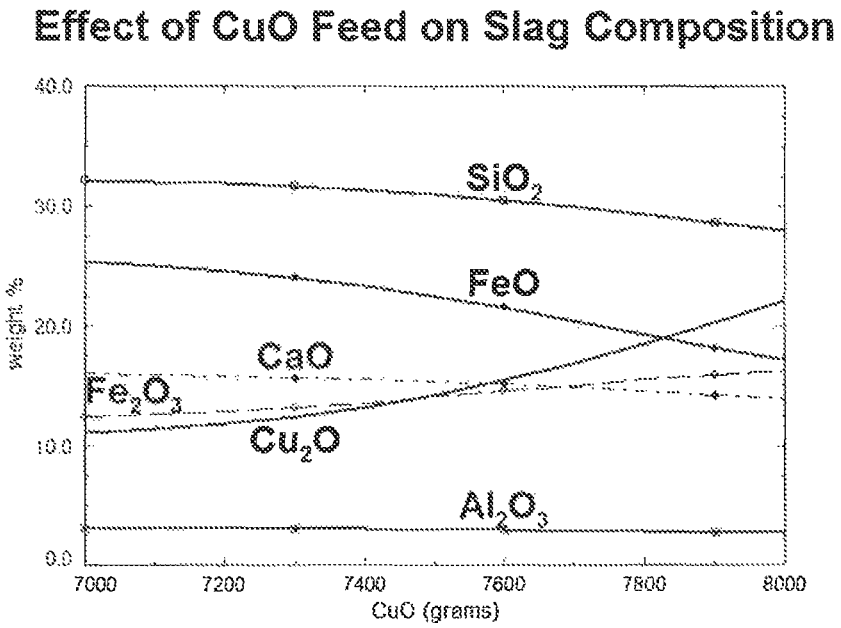
Figure 6:
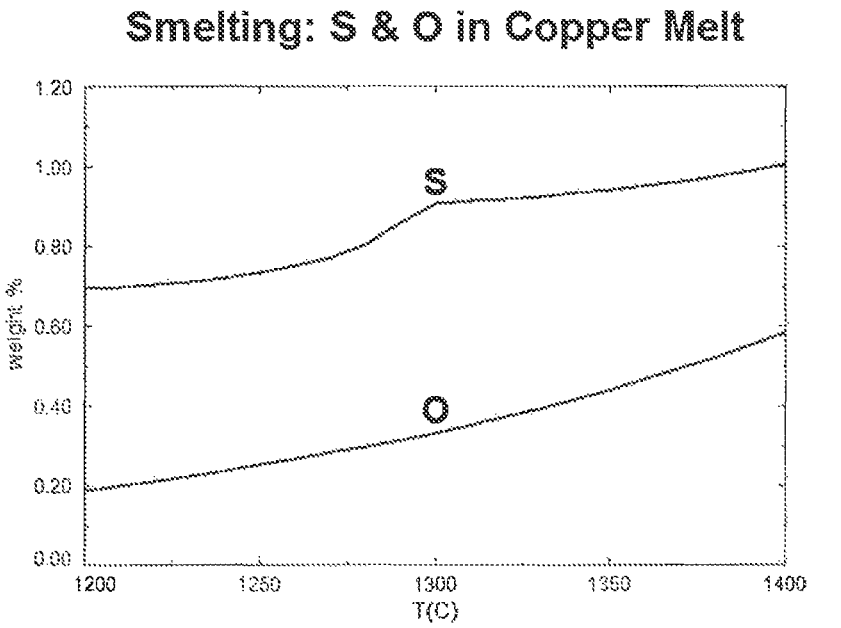

A room temperature copper concentrate comprising 3000 kg $CuFeS_2$, 173.4 kg $FeS_2$, and 294.8 kg gangue (CaO, $Al_2O_3$, $SiO_2$), preferably in free flowing powder form, is to be mixed with 7400 kg of CuO at 800° C. in the first smelting furnace (Table 1). Heat and material balances were calculated using HSC 7.1 Chemistry for Windows thermochemical software[13]. Silica (1000 kg) and lime (500 kg) fluxes are also taken as to be added to the melt. The melt is to be heated to 1300° C. via electrical and/or combustion heating. The reaction produces a metallic copper melt, an oxidized slag, and a rich $SO_2$ gas stream. In this Example, 14% excess CuO is used to produce an optimal copper melt and an optimal slag (FIGS. 3, 4, and 5). The copper melt is 98.8% copper with 0.002% Fe, and 0.88% S (FIG. 6). The slag includes some copper oxide (as $Cu_2O$), iron oxides and gangue and flux derivatives. All compositions herein are weight percent unless otherwise noted.

[13]Roine, A., et al., HSC 7.11, Outotec, Pori, Finland (2011).

Figure 7:
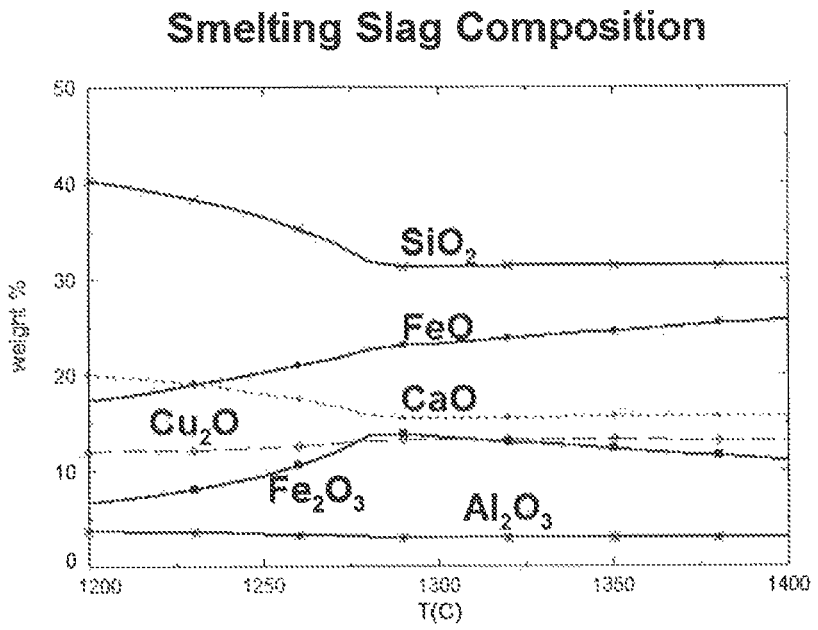
Figure 8:
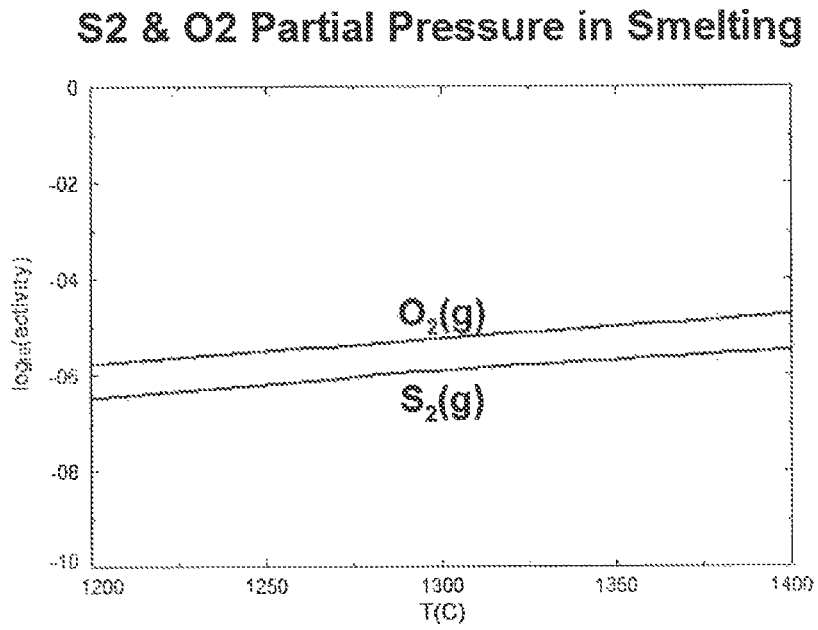
Figure 9:
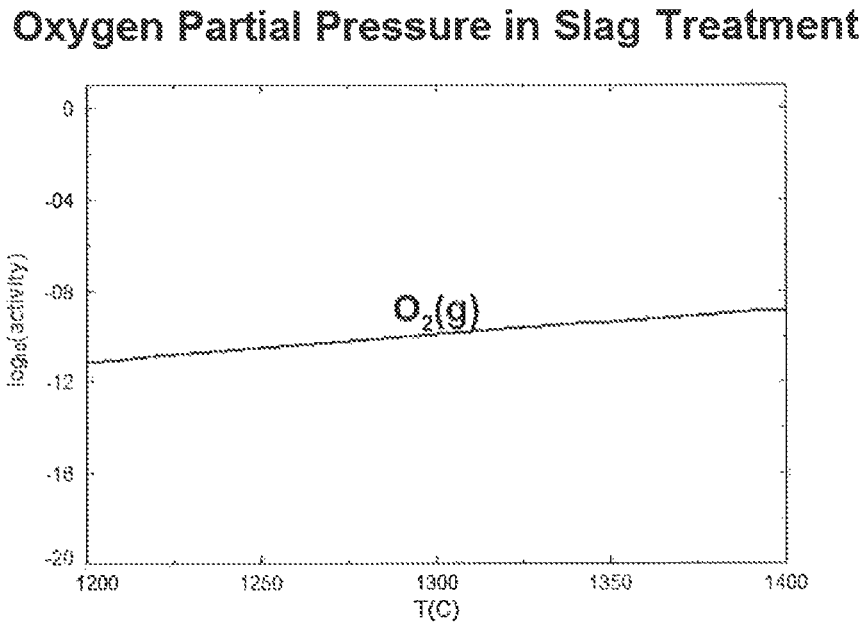

As discussed in the above Summary of the Invention, the copper solubility in the slag is largely dependent on the degree of oxidation of the iron also present in the slag. The fluxes added to the furnace are designed to aid in slag formation and produce a low melting, fluid slag. The slag produced in this Example melts at 110° C. with a viscosity of 2.0 poise (at 1300° C.). The $Cu_2O$ content in the slag is 13.2%, and requires treatment to recover as much of this copper as possible (FIG. 7). FIG. 7 demonstrates that during smelting, the copper content in the slag is largely independent of the slag composition and operating temperature. However, as shown in comparing FIGS. 8 and 9, the dramatically higher $O_2$ partial pressure above the slag in the electric furnace as compared to the $O_2$ partial pressure above the slag in the slag treatment furnace leads to different slag chemistries. Most notably, the decreased copper solubility in the slag after slag treatment can be explained by considering the lower oxygen partial pressure present in the treatment furnace. This demonstrates that the copper content in the slag can be controlled by the oxygen partial pressure.

TABLE 1

Electric Furnace Heat & Material Balance

| | Temperature © | Amount, kmol | Amount, kg | Amount, Nm3 | Latent H, kWh | Total H, kWh |
|---|---|---|---|---|---|---|
| INPUT | | | | | | |
| Cu Concentrate | 25.000 | 18.853 | 3468.198 | 0.855 | 0.00 | −2180.49 |
| CuFeS2 | 25.000 | 16.348 | 3000.000 | 0.714 | 0.00 | −864.48 |
| FeS2 | 25.000 | 1.445 | 173.400 | 0.035 | 0.00 | −71.56 |
| CaO*Al2O3*2SiO2 | 25.000 | 1.060 | 294.798 | 0.107 | 0.00 | −1244.44 |
| Recycled CuO | 800.000 | 93.029 | 7400.000 | 1.173 | 1025.04 | −3040.27 |
| CuO | 800.000 | 93.029 | 7400.000 | 1.173 | 1025.04 | −3040.27 |
| Flux | 25.000 | 25.559 | 1500.000 | 0.534 | 0.00 | −5783.49 |
| SiO2 | 25.000 | 16.643 | 1000.000 | 0.385 | 0.00 | −4211.01 |
| CaO | 25.000 | 8.916 | 500.000 | 0.150 | 0.00 | −1572.47 |
| Heating | 25.000 | 47.972 | 1243.806 | 888.658 | 0.00 | 0.00 |
| C | 25.000 | 8.326 | 100.000 | 0.044 | 0.00 | 0.00 |
| O2(g) | 25.000 | 8.326 | 266.412 | 186.609 | 0.00 | 0.00 |
| N2(g) | 25.000 | 31.320 | 877.394 | 702.005 | 0.00 | 0.00 |
| Energy Required | | | | | | 2493.56 |
| OUTPUT | | | | | | |
| Copper Melt | 1300.000 | 105.915 | 6607.987 | 31.555 | 1449.45 | 1544.56 |
| Cu | 1300.000 | 102.724 | 6527.713 | 0.729 | 1417.28 | 1417.28 |
| Fe | 1300.000 | 0.003 | 0.142 | 0.000 | 0.03 | 0.03 |
| S | 1300.000 | 1.814 | 58.147 | 0.028 | 21.91 | 21.91 |
| O(g) | 1300.000 | 1.374 | 21.985 | 30.799 | 10.22 | 105.33 |
| Slag | 1300.000 | 47.844 | 3596.867 | 0.940 | 1233.75 | −7504.18 |
| Al2O3 | 1300.000 | 1.059 | 108.020 | 0.027 | 44.85 | −448.28 |
| SiO2 | 1300.000 | 18.759 | 1127.114 | 0.434 | 461.01 | −4285.28 |
| CaO | 1300.000 | 9.973 | 559.294 | 0.167 | 178.67 | −1580.27 |
| FeO | 1300.000 | 11.671 | 838.491 | 0.140 | 240.41 | −641.78 |
| Fe2O3 | 1300.000 | 3.057 | 488.235 | 0.093 | 154.03 | −547.63 |
| Cu2O | 1300.000 | 3.325 | 475.714 | 0.079 | 154.79 | −0.93 |
| Flue Gas | 1300.000 | 73.419 | 3407.221 | 1645.574 | 1143.46 | −2551.06 |
| SO2(g) | 1300.000 | 33.772 | 2163.415 | 756.960 | 634.42 | −2150.05 |
| CO2(g) | 1300.000 | 8.326 | 366.412 | 186.609 | 152.67 | −757.38 |
| N2(g) | 1300.000 | 31.320 | 877.394 | 702.005 | 356.37 | 356.37 |

TABLE 2

| Slag Treatment Furnace Heat & Material Balance | | | | | | |
|---|---|---|---|---|---|---|
| | Temperature © | Amount, kmol | Amount, kg | Amount, Nm3 | Latent H, kWh | Total H, kWh |
| INPUT Slag Furnace | | | | | | |
| Slag | 1300.000 | 47.844 | 3596.867 | 0.940 | 1233.75 | −7504.18 |
| Al2O3 | 1300.000 | 1.059 | 108.020 | 0.027 | 44.85 | −448.28 |
| SiO2 | 1300.000 | 18.759 | 1127.114 | 0.434 | 461.01 | −4285.28 |
| CaO | 1300.000 | 9.973 | 559.294 | 0.167 | 178.67 | −1580.27 |
| FeO | 1300.000 | 11.671 | 838.491 | 0.140 | 240.41 | −641.78 |
| Fe2O3 | 1300.000 | 3.057 | 488.235 | 0.093 | 154.03 | −547.63 |
| Cu2O | 1300.000 | 3.325 | 475.714 | 0.079 | 154.79 | -0.93 |
| Reductant | 25.000 | 4.329 | 52.000 | 0.023 | 0.00 | 0.00 |
| C | 25.000 | 4.329 | 52.000 | 0.023 | 0.00 | 0.00 |
| S | 25.000 | 0.000 | 0.000 | 0.000 | 0.00 | 0.00 |
| Energy Required | | | | | | 76.99 |
| OUTPUT | | | | | | |
| Copper Melt | 1300.000 | 6.573 | 417.129 | 0.053 | 90.67 | 90.68 |
| Cu | 1300.000 | 6.498 | 412.946 | 0.046 | 89.66 | 89.66 |
| Fe | 1300.000 | 0.075 | 4.179 | 0.001 | 1.01 | 1.01 |
| O(g) | 1300.000 | 0.000 | 0.004 | 0.006 | 0.00 | 0.02 |
| Treated Slag | 1300.000 | 47.430 | 3080.021 | 0.843 | 1054.22 | −7298.04 |
| Al2O3 | 1300.000 | 1.059 | 108.019 | 0.027 | 44.85 | −448.28 |
| SiO2 | 1300.000 | 18.759 | 1127.126 | 0.434 | 461.01 | −4285.33 |
| CaO | 1300.000 | 9.973 | 559.297 | 0.167 | 178.68 | −1580.28 |
| FeO | 1300.000 | 17.416 | 1251.250 | 0.209 | 358.75 | −957.71 |
| Fe2O3 | 1300.000 | 0.147 | 23.551 | 0.004 | 7.43 | −26.42 |
| Cu2O | 1300.000 | 0.075 | 10.778 | 0.002 | 3.51 | −0.02 |
| Flue Gas | 1300.000 | 4.330 | 151.739 | 97.040 | 62.79 | −219.84 |
| CO(g) | 1300.000 | 2.425 | 67.932 | 54.358 | 27.86 | −46.60 |
| CO2(g) | 1300.000 | 1.904 | 83.807 | 42.682 | 34.92 | −173.23 |

The $SO_2$ stream produced during the smelting step is sent to an acid plant for sulfuric acid production. The $SO_2$ content of the off gas in this Example is 46%. Significant energy can be captured during sulfuric acid production, and this energy can be used to improve the overall energy balance of the Looping Sulfide Oxidation process.

Slag Treatment

Figure 10:
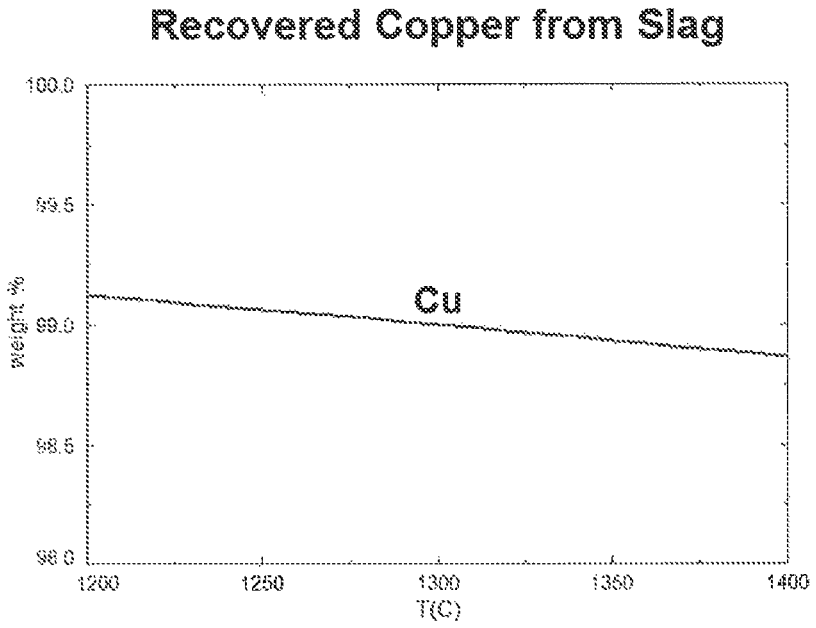
Figure 11:
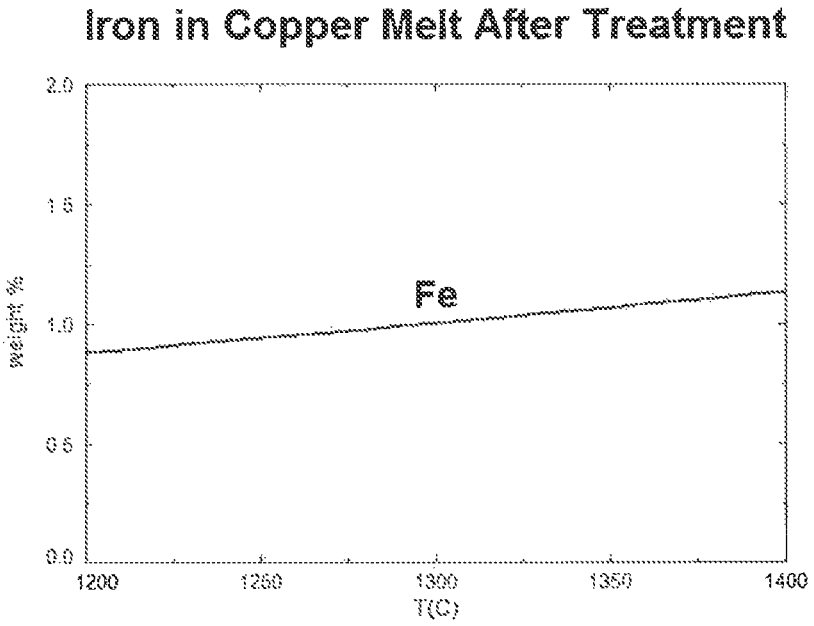
Figure 12:
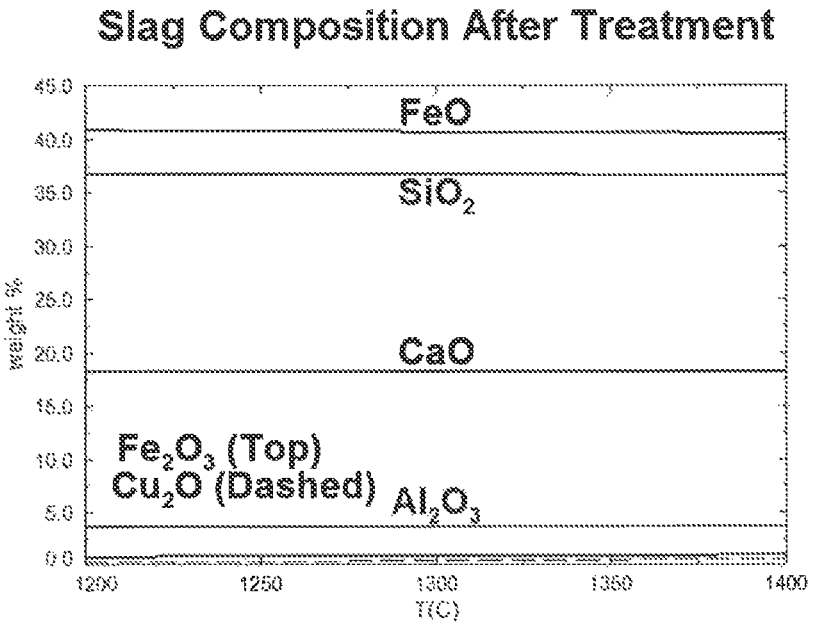
Figure 13:
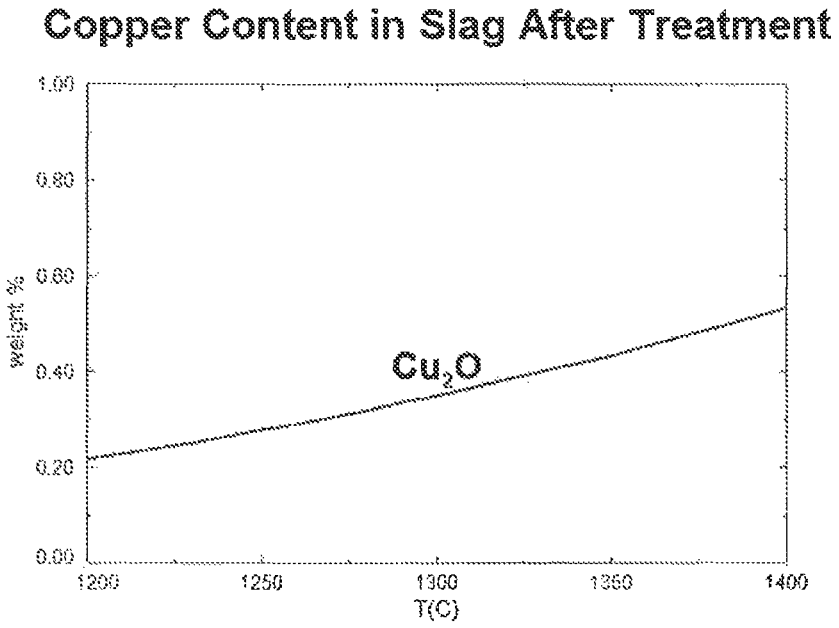

The slag produced in the electric furnace (3.0% $Al_2O_3$, 31.3% $SiO_2$, 15.5% CaO, 23.3% FeO, 13.6% $Fe_2O_3$, 13.2% $Cu_2O$) is transferred to an electrical furnace at 1300° C. for slag treatment (Table 2). In this Example the 3596.9 kg of slag is treated with 52 kg of carbon to reduce $Fe_2O_3$ and $Cu_2O$. By reducing the trivalent iron, the solubility of copper in the slag is dramatically reduced. As a result, a copper melt is formed with 97.7% of the copper recovered (417.1 kg melt, 98.997% Cu, 1.0% Fe) (FIGS. 10 and 11). The remaining slag contains only 0.35% $Cu_2O$ and is fit for disposal as waste (melting temperature, 1070° C.; viscosity 1.7 poise at 1300° C.) (FIGS. 12 and 13). The copper melt produced during slag treatment is blended with the copper melt from the electric furnace to produce a copper stream (7025.1 kg, 98.798% Cu, 0.062% Fe, 0.828% S, 0.313% O) for treatment in the anode furnace.

The heat required to perform the slag treatment will be provided by electrical heating via the electric furnace. Natural gas for combustion heating can also be provided via tuyères.

Downer Reoxidation Furnace

In a downer furnace, molten copper is atomized and oxidized in situ to fine particulate CuO. Atomizing the molten copper minimizes mass transfer limitations between the molten copper and the oxygen and leads to near 100% conversion to CuO. This highly exothermic reaction provides significant potential for energy capture. It is understood that molten CuO is highly corrosive, so following oxidation cool air is introduced to solidify the CuO. The CuO is thus cooled down to 800° C. before it exits as a fine particulate and is recycled back at temperature to the first furnace. Looping of this material in this system at temperature and at high processing speed enhances the overall energy balance of the process.

The flue gases are sent to an air/air heat exchanger, where the reaction air for the downer furnace and anode furnace are preheated to 400° C. in order to maximize the thermal efficiency. The flue gas is then sent to a boiler where a significant portion of the energy is captured as high pressure steam.

TABLE 3

| Reoxidation Heat & Material Balance | | | | | | |
|---|---|---|---|---|---|---|
| | Temperature © | Amount, kmol | Amount, kg | Amount, Nm3 | Latent H, kWh | Total H, kWh |
| INPUT Reoxidation | | | | | | |
| Copper | 1300.000 | 93.105 | 5915.483 | 0.862 | 1284.49 | 1285.11 |
| Cu | 1300.000 | 93.029 | 5911.598 | 0.660 | 1283.51 | 1283.51 |
| Fe | 1300.000 | 0.066 | 3.676 | 0.000 | 0.89 | 0.89 |

TABLE 3-continued

| Reoxidation Heat & Material Balance | | | | | | |
|---|---|---|---|---|---|---|
| | Temperature © | Amount, kmol | Amount, kg | Amount, Nm3 | Latent H, kWh | Total H, kWh |
| O(g) | 1300.000 | 0.009 | 0.144 | 0.202 | 0.07 | 0.69 |
| S | 1300.000 | 0.002 | 0.065 | 0.000 | 0.02 | 0.02 |
| Reaction Air | 400.000 | 221.497 | 6390.255 | 4964.539 | 690.25 | 690.25 |
| O2(g) | 400.000 | 46.514 | 1488.402 | 1042.553 | 150.10 | 150.10 |
| N2(g) | 400.000 | 174.982 | 4901.853 | 3921.986 | 540.15 | 540.15 |
| OUTPUT | | | | | | |
| Copper Oxides | 1243.850 | 46.514 | 6661.065 | 1.109 | 1421.58 | −502.52 |
| Cu2O | 1243.850 | 21.882 | 3131.100 | 0.522 | 585.95 | −438.94 |
| Cu2O(1) | 1243.850 | 24.600 | 3520.000 | 0.587 | 832.15 | −57.68 |
| Cu2O*Fe2O3 | 1243.850 | 0.033 | 9.965 | 0.000 | 3.48 | −5.90 |
| Flue Gas | 1243.850 | 198.197 | 5644.748 | 4442.302 | 2161.41 | 2161.24 |
| N2(g) | 1243.850 | 174.982 | 4901.853 | 3921.986 | 1895.51 | 1895.51 |
| O2(g) | 1243.850 | 23.212 | 742.764 | 520.270 | 265.86 | 265.86 |
| SO2(g) | 1243.850 | 0.002 | 0.131 | 0.046 | 0.04 | −0.13 |

TABLE 4

| Quench Cooling of Reoxidation Products | | | | | | |
|---|---|---|---|---|---|---|
| | Temperature © | Amount, kmol | Amount, kg | Amount, Nm3 | Latent H, kWh | Total H, kWh |
| INPUT Reoxidation-Quench Cooling | | | | | | |
| Copper Oxides | 1243.850 | 46.514 | 6661.065 | 1.109 | 1421.58 | −502.52 |
| Cu2O | 1243.850 | 21.882 | 3131.100 | 0.522 | 585.95 | −438.94 |
| Cu2O(1) | 1243.850 | 24.600 | 3520.000 | 0.587 | 832.15 | −57.68 |
| Cu2O*Fe2O3 | 1243.850 | 0.033 | 9.965 | 0.000 | 3.48 | −5.90 |
| Flue Gas | 1243.850 | 198.197 | 5644.748 | 4442.302 | 2161.41 | 2161.24 |
| N2(g) | 1243.850 | 174.982 | 4901.853 | 3921.986 | 1895.51 | 1895.51 |
| O2(g) | 1243.850 | 23.212 | 742.764 | 520.270 | 265.86 | 265.86 |
| SO2(g) | 1243.850 | 0.002 | 0.131 | 0.046 | 0.04 | −0.13 |
| Cooling Air | 25.000 | 528.256 | 15240.366 | 11840.122 | 0.00 | 0.00 |
| N2(g) | 25.000 | 417.322 | 11690.618 | 9353.697 | 0.00 | 0.00 |
| O2(g) | 25.000 | 110.934 | 3549.748 | 2486.426 | 0.00 | 0.00 |
| OUTPUT | | | | | | |
| Copper Oxides | 800.000 | 93.029 | 7405.274 | 1.172 | 1026.09 | −3046.62 |
| CuO | 800.000 | 92.996 | 7397.400 | 1.172 | 1024.68 | −3039.20 |
| CuO*Fe2O3 | 800.000 | 0.033 | 7.874 | 0.000 | 1.41 | −7.42 |
| Flue Gas | 800.000 | 703.196 | 20140.911 | 15761.146 | 4705.52 | 4705.35 |
| N2(g) | 800.000 | 592.305 | 16592.471 | 13275.683 | 3927.10 | 3927.10 |
| O2(g) | 800.000 | 110.889 | 3548.310 | 2485.418 | 778.39 | 778.39 |
| SO2(g) | 800.000 | 0.002 | 0.131 | 0.046 | 0.02 | −0.15 |

In this Example, 7400 kg of CuO are required in the electric furnace. As such, 5911.1 kg of molten Cu must be oxidized in the downer reoxidation furnace; the remaining 1020.5 kg of Cu can be sent to electrolysis for final purification (Tables 3 and 4). In the downer reoxidation furnace a significant excess of air will be used to ensure complete reoxidation.

Energy is captured during this step by using the flue gases from the reoxidation furnace to (1) preheat the oxidation air and (2) produce high pressure steam in a boiler after preheating.

Energy Balance

The two primary energy producing steps in the Looping Sulfide Oxidation process are the sulfuric acid production in the acid plant and the reoxidation of the Cu to CuO before it is looped back to the electric furnace. The acid plant per se, is outside the scope of this invention; however, as it is known to those skilled in the art, state-of-the-art processes like the Lurec® process have been shown to capture significant portions of the total energy available during sulfuric acid production[14]. On this basis, we have evaluated the energy balance of the Looping Sulfide Oxidation process relative to conventional copper processing.

[14]Daum K H, The Lurec® Process—Key to Economic Smelter Acid Plant Operation, in The Southern African Institute of Mining and Metallurgy Sulfur and Sulfuric Acid Conference 2009, 1-22.

During conventional copper processing, the only major energy producing step is the acid production. It is estimated that the theoretical total amount of energy that can be produced during this step is 54.7 Wh per mole of $CuFeS_2$ processed.

$$2SO_2+O_2 \rightarrow 2SO_3 \quad \Delta H_{600^\circ C.} = -54.7 \text{ Wh} \tag{6}$$

In this analysis, production of sulfuric acid is estimated to result in the production of 2462 kg of high pressure steam (100 bar, 350° C.) per 1000 kg of Cu produced during heat capture in boilers and cooling jackets (Tables 5 and 6).

TABLE 5

| Acid Plant Boiler Heat & Material Balance | | | | | | |
|---|---|---|---|---|---|---|
| | Temperature © | Amount, kmol | Amount, kg | Amount, Nm3 | Latent H, kWh | Total H, kWh |
| INPUT Acid Plant System-Boiler 1 | | | | | | |
| Gas from Smelting | 1300.000 | 73.419 | 3407.221 | 1645.574 | 1143.46 | −2551.06 |
| SO2(g) | 1300.000 | 33.772 | 2163.415 | 756.960 | 634.42 | −2150.05 |
| CO2(g) | 1300.000 | 8.326 | 366.412 | 186.609 | 152.67 | −757.38 |
| N2(g) | 1300.000 | 31.320 | 877.394 | 702.005 | 356.37 | 356.37 |
| Gas from Anode Furnace | 1200.000 | 50.173 | 1437.869 | 1124.550 | 580.51 | −561.04 |
| N2(g) | 1200.000 | 35.269 | 987.991 | 790.495 | 367.09 | 367.09 |
| SO2(g) | 1200.000 | 1.810 | 115.964 | 40.575 | 31.08 | −118.18 |
| O2(g) | 1200.000 | 0.003 | 0.082 | 0.057 | 0.03 | 0.03 |
| NO(g) | 1200.000 | 0.001 | 0.026 | 0.019 | 0.01 | 0.03 |
| SO3(g) | 1200.000 | 0.001 | 0.052 | 0.015 | 0.02 | −0.06 |
| H2O(g) | 1200.000 | 8.273 | 149.040 | 185.428 | 108.08 | −447.65 |
| CO2(g) | 1200.000 | 3.849 | 169.393 | 86.270 | 64.33 | −356.39 |
| CO(g) | 1200.000 | 0.514 | 14.407 | 11.528 | 5.41 | −10.38 |
| H2(g) | 1200.000 | 0.453 | 0.914 | 10.163 | 4.46 | 4.46 |
| Cooling Water | 25.000 | 89.461 | 1611.655 | 1.617 | 0.00 | −7098.80 |
| H2O(100 barl) | 25.000 | 89.461 | 1611.655 | 1.617 | 0.00 | −7098.80 |
| OUTPUT | | | | | | |
| Gas to Scrubbing | 400.000 | 123.591 | 4845.090 | 2770.123 | 465.76 | −4370.31 |
| SO2(g) | 400.000 | 35.583 | 2279.379 | 797.534 | 171.29 | −2762.43 |
| CO2(g) | 400.000 | 12.175 | 535.805 | 272.879 | 55.58 | 1275.20 |
| N2(g) | 400.000 | 66.589 | 1865.385 | 1492.500 | 205.55 | 205.55 |
| O2(g) | 400.000 | 0.003 | 0.082 | 0.057 | 0.01 | 0.01 |
| NO(g) | 400.000 | 0.001 | 0.026 | 0.019 | 0.00 | 0.02 |
| SO3(g) | 400.000 | 0.001 | 0.052 | 0.015 | 0.00 | −0.07 |
| H2O(g) | 400.000 | 8.273 | 149.040 | 185.428 | 30.33 | −525.40 |
| CO(g) | 400.000 | 0.514 | 14.407 | 11.528 | 1.62 | −14.17 |
| H2(g) | 400.000 | 0.453 | 0.914 | 10.163 | 1.37 | 1.37 |
| High Pressure Steam | 350.000 | 89.461 | 1611.655 | 2005.140 | 485.79 | −5840.59 |
| H2O(100 barg) | 350.000 | 89.461 | 1611.655 | 2005.140 | 485.79 | −5840.59 |

TABLE 6

| Catalyst Bed Heat & Material Balance | | | | | | |
|---|---|---|---|---|---|---|
| | Temperature © | Amount, kmol | Amount, kg | Amount, Nm3 | Latent H, kWh | Total H, kWh |
| INPUT Catalyst Bed | | | | | | |
| Post-Scrub Gas Stream | 80.000 | 114.346 | 4680.570 | 2562.913 | 59.08 | −4205.41 |
| SO2(g) | 80.000 | 35.583 | 2279.379 | 797.534 | 22.29 | −2911.43 |
| N2(g) | 80.000 | 66.589 | 1865.385 | 1492.500 | 29.65 | 29.65 |
| CO2(g) | 80.000 | 12.175 | 535.805 | 272.879 | 7.14 | −1323.64 |
| Reaction Air | 25.000 | 93.193 | 2688.636 | 2088.781 | 0.00 | 0.00 |
| O2(g) | 25.000 | 19.570 | 626.230 | 438.644 | 0.00 | 0.00 |
| N2(g) | 25.000 | 73.622 | 2062.406 | 1650.137 | 0.00 | 0.00 |
| Cooling Water | 25.000 | 47.217 | 850.633 | 0.853 | 0.00 | −3746.75 |
| H2O(100 barl) | 25.000 | 47.217 | 850.633 | 0.853 | 0.00 | −3746.75 |
| OUTPUT | | | | | | |
| Catalyzed Gas | 225.000 | 189.748 | 7369.206 | 4252.926 | 373.05 | −4869.49 |
| SO3(g) | 225.000 | 35.583 | 2848.680 | 797.534 | 114.14 | −3797.62 |
| N2(g) | 225.000 | 140.211 | 3927.791 | 3142.636 | 228.08 | 228.08 |
| CO2(g) | 225.000 | 12.175 | 535.805 | 272.879 | 27.84 | −1302.94 |
| O2(g) | 225.000 | 1.779 | 56.930 | 39.877 | 2.98 | 2.98 |
| High Pressure Steam | 350.000 | 47.217 | 850.633 | 1058.314 | 256.40 | −3082.67 |
| H2O(100 barg) | 350.000 | 47.217 | 850.633 | 1058.314 | 256.40 | −3082.67 |

Therefore, with all other factors being equal, conventional copper processing and Looping Sulfide Oxidation processing would theoretically produce equal amounts of energy during sulfuric acid production. However, as the Lurec® process states, the higher the strength of the $SO_2$ stream, the greater the energy production; therefore, it can be expected that, in practice, the Looping Sulfide Oxidation process would actually produce more energy than the conventional process due to its high strength $SO_2$ stream. However, if equal energy production is assumed in the acid plant, the only major differentiating factor in energy production will be during the reoxidation of the copper to CuO, which the conventional process does not perform. During reoxidation, the amount of high pressure steam (100 bar, 350° C.) that is estimated to be produced is 4049 kg per 1000 kg of Cu produced (Tables 7 and 8).

TABLE 7

| Reoxidation Reaction Air Preheater Heat & Material Balance | | | | | | |
|---|---|---|---|---|---|---|
| | Temperature © | Amount, kmol | Amount, kg | Amount, Nm3 | Latent H, kWh | Total H, kWh |
| INPUT Reoxidation Heat Recovery-Air Preheater | | | | | | |
| New Reaction Air | 25.000 | 266.141 | 7678.264 | 5965.184 | 0.00 | 0.00 |
| O2(g) | 25.000 | 55.890 | 1788.402 | 1252.689 | 0.00 | 0.00 |
| N2(g) | 25.000 | 210.252 | 5889.862 | 4712.495 | 0.00 | 0.00 |
| Reoxidation Flue Gases | 800.000 | 703.196 | 20140.911 | 15761.146 | 4705.52 | 4705.35 |
| N2(g) | 800.000 | 592.305 | 16592.471 | 13275.683 | 3927.10 | 3927.10 |
| O2(g) | 800.000 | 110.889 | 3548.310 | 2485.418 | 778.39 | 778.39 |
| SO2(g) | 800.000 | 0.002 | 0.131 | 0.046 | 0.02 | −0.15 |
| OUTPUT | | | | | | |
| New Reaction Air | 400.000 | 266.141 | 7678.264 | 5965.184 | 829.38 | 829.38 |
| O2(g) | 400.000 | 55.890 | 1788.402 | 1252.689 | 180.35 | 180.35 |
| N2(g) | 400.000 | 210.252 | 5889.862 | 4712.495 | 649.02 | 649.02 |
| Reoxidation Flue Gases | 671.626 | 703.194 | 20140.780 | 15761.101 | 3875.97 | 3875.97 |
| N2(g) | 671.626 | 592.305 | 16592.471 | 13275.683 | 3235.65 | 3235.65 |
| O2(g) | 671.626 | 110.889 | 3548.310 | 2485.418 | 640.32 | 640.32 |
| SO2(g) | 671.626 | 0.000 | 0.000 | 0.000 | 0.00 | 0.00 |

TABLE 8

| Reoxidation Boiler Heat & Material Balance | | | | | | |
|---|---|---|---|---|---|---|
| | Temperature © | Amount, kmol | Amount, kg | Amount, Nm3 | Latent H, kWh | Total H, kWh |
| INPUT Reoxidation Heat Recovery-Boiler | | | | | | |
| Reoxidation Flue Gases | 671.626 | 703.194 | 20140.780 | 15761.101 | 3875.97 | 3875.97 |
| N2(g) | 671.626 | 592.305 | 16592.471 | 13275.683 | 3235.65 | 3235.65 |
| O2(g) | 671.626 | 110.889 | 3548.310 | 2485.418 | 640.32 | 640.32 |
| SO2(g) | 671.626 | 0.000 | 0.000 | 0.000 | 0.00 | 0.00 |
| Cooling Water | 25.000 | 224.748 | 4048.881 | 4.061 | 0.00 | −17833.96 |
| H2O(100 barl) | 25.000 | 224.748 | 4048.881 | 4.061 | 0.00 | −17833.96 |
| OUTPUT | | | | | | |
| Reoxidation Flue Gases | 150.000 | 703.194 | 20140.780 | 15761.101 | 715.05 | 715.05 |
| N2(g) | 150.000 | 592.305 | 16592.471 | 13275.683 | 600.31 | 600.31 |
| O2(g) | 150.000 | 110.889 | 3548.310 | 2485.418 | 114.73 | 114.73 |
| SO2(g) | 150.000 | 0.000 | 0.000 | 0.000 | 0.00 | 0.00 |
| High Pressure Steam | 350.000 | 224.748 | 4048.881 | 5037.413 | 1220.43 | −14673.04 |
| H2O(100 barg) | 350.000 | 224.748 | 4048.881 | 5037.413 | 1220.43 | −14673.04 |

Taking into consideration the total estimated energy output during Looping Sulfide Oxidation, the amount of energy available for capture during the reoxidation of the molten copper is approximately 1.64 times greater than the amount available for capture during sulfuric acid production alone. This comparison is vital because during conventional processing, significant energy consumptions and productions have been observed at different processing facilities[15]. Therefore, on the basis of potential energy available for capture, the Looping Sulfide Oxidation process provides significant improvements over the conventional technology; the increased energy production drastically mitigates the net energy consumption during copper processing.

[15]Coursol P, Mackey P J, and Diaz C M (2010) Energy Consumption in Copper Sulphide Smelting, in *Proceedings of Copper* 2010, 1-22.

Example 2

Figure 14:
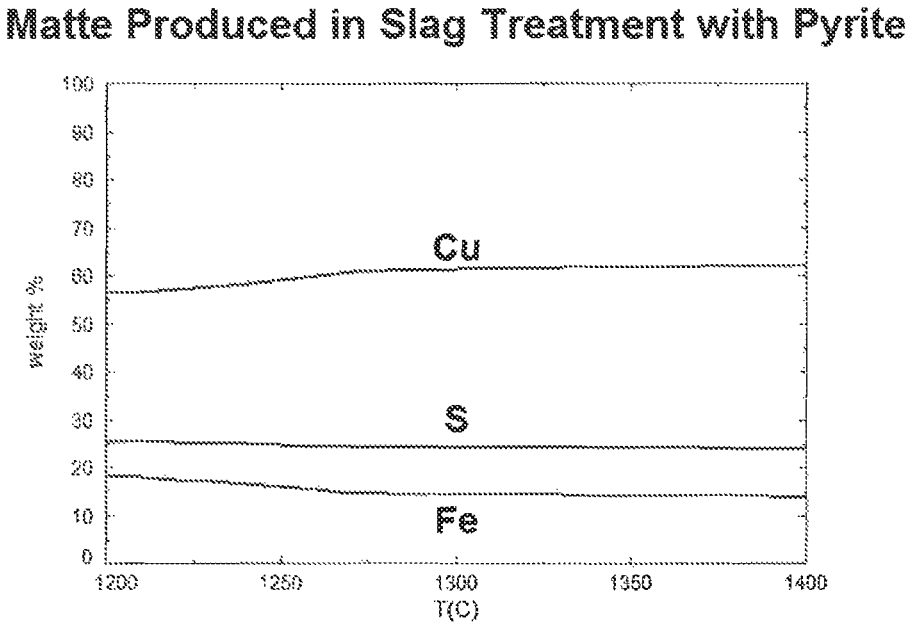

Using the same feed conditions and smelting furnace parameters as those presented in Example 1, the slag produced in the smelting furnace can be treated in the slag treatment furnace by sulfidation. During sulfidation, iron pyrite ($FeS_2$) is added to the molten slag to sulfidize the copper, causing it to separate out of the slag into a copper matte (FIGS. 14 and 15). In this scheme, the copper recovery from the slag ranges from 99 to 96% in the temperature range of 1200-1400° C. The slag has a melting temperature of 1120° C. and a viscosity of 0.709 poise at 1300° C. The treated slag is fit for disposal as waste. The copper matte, which is now rich in copper sulfide, must be processed in the smelting furnace again before the copper can be sent to the anode furnace as blister copper.

Example 3

Figure 17:
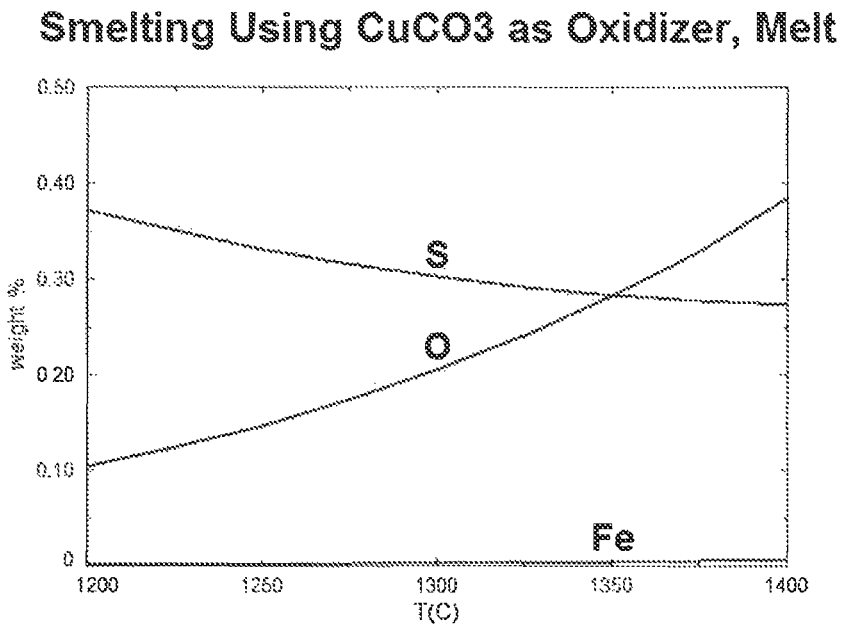
Figure 18:
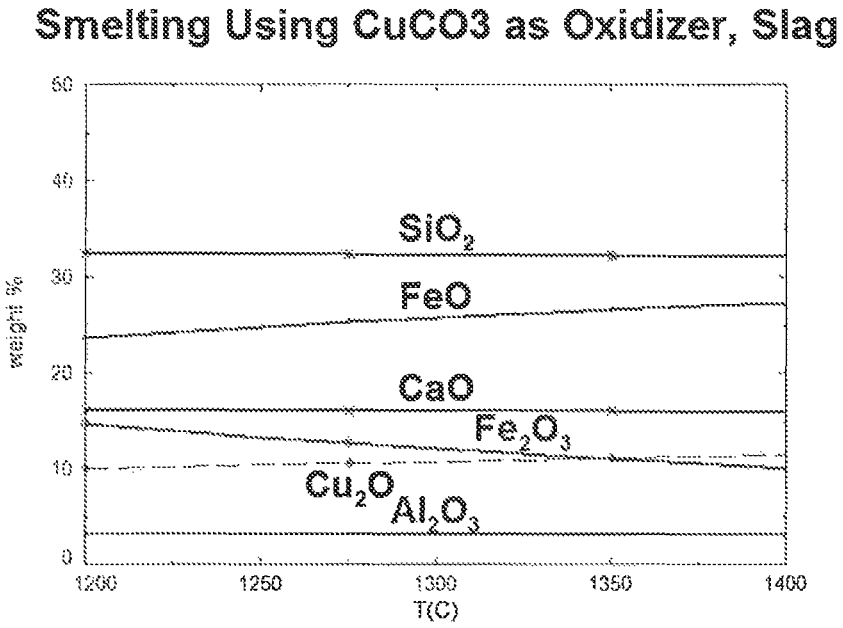
Figure 19:
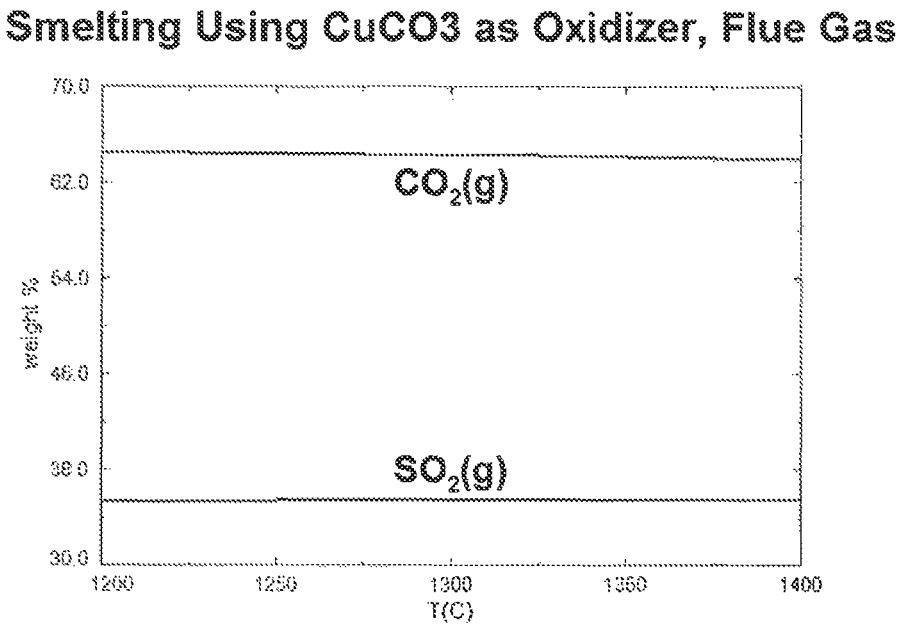

Copper sulfide concentrate ($CuFeS_2$) is smelted with $CuCO_3$ to produce copper metal, iron oxide slag, and rich $SO_2$ off gas (FIGS. 16-18). In such a reaction, 3000 kg of $CuFeS_2$ (with 173.4 kg of $FeS_2$ and 294.8 kg of $CaAl_2Si_2O_8$) is reacted with 11500 kg of $CuCO_3$ and 1000 kg of $SiO_2$ and 500 kg of CaO between 1200° C. and 1400° C. The products of this reaction will include an off gas that is comprised mainly of $CO_2$ and $SO_2$ (FIG. 19). At 1300° C., 6654 kg of molten Cu will be produced containing 0.30% S, 0.21% O and 0.0028% Fe. The 3490 kg of slag produced contains 10.7% $Cu_2O$.

Example 4

Figure 20:
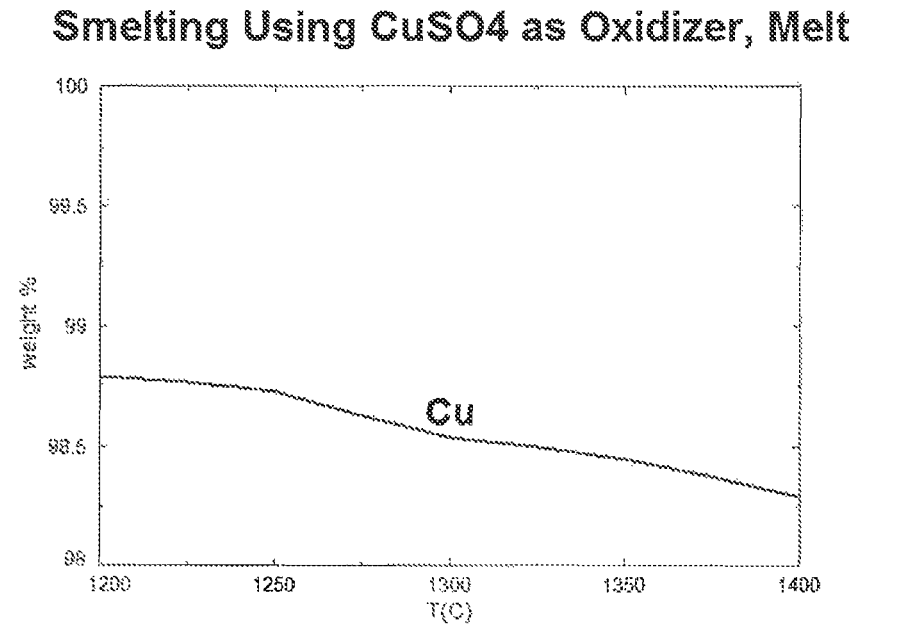
FIGS. 20-22 show traces of thermodynamic data detailing the smelting of $CuFeS_2$ with $CuSO_4$.
Figure 21:
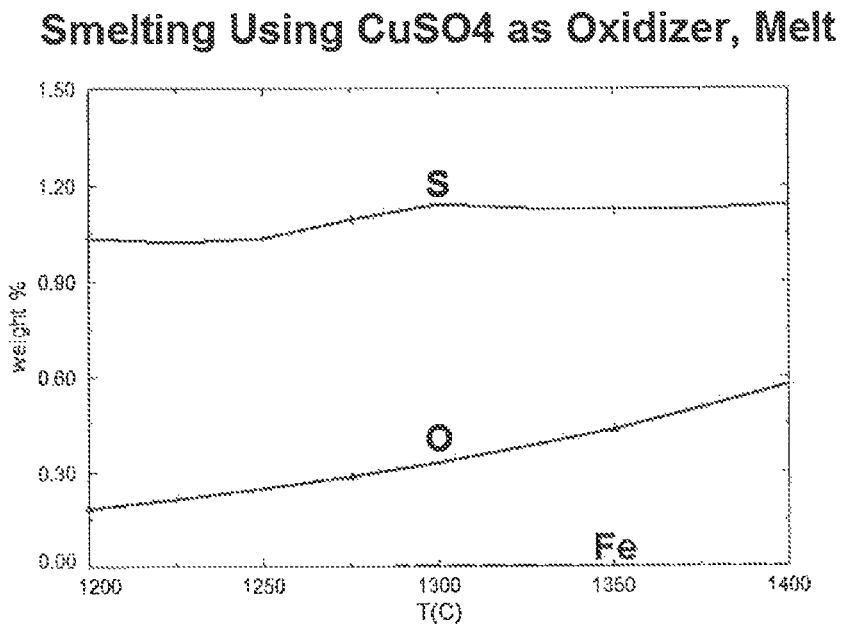
Figure 22:
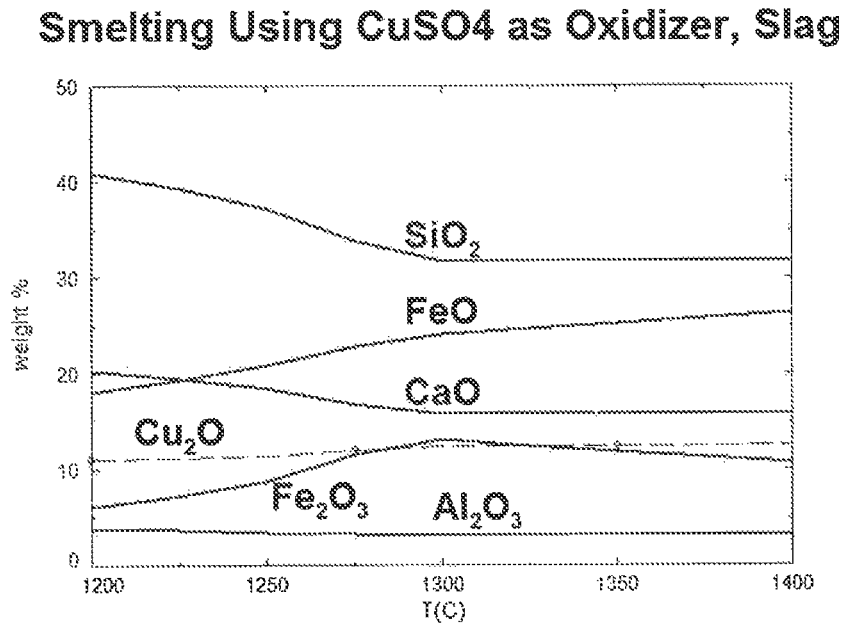

Copper sulfide concentrate ($CuFeS_2$) is smelted with $CuSO_4$ to produce copper metal, iron oxide slag and rich $SO_2$ off gas (FIG. 20-22). In such a reaction, 3000 kg $CuFeS_2$ (with 173.4 kg $FeS_2$, 294.8 kg $CaAl_2Si_2O_8$) is reacted with 7423 kg $CuSO_4$ and 1000 kg $SiO_2$ and 500 kg CaO between 1200° C. and 1400° C. The products of this reaction will include an off gas that is comprised of $SO_2$ that is diluted with any combustion gases or inert gases. At 1300° C., 3658 kg of molten copper will be produced containing 1.1% S, 0.33% O and 0.0025% Fe. The 3559 kg of slag produced contains 12.3% $Cu_2O$.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A method for production of copper comprising:

(a) providing (1) a copper sulfide concentrate product of mining or mineral refining comprising copper and iron metal including sulfides thereof and (2) one or more copper oxides, to a molten bath wherein they react with each other for smelting desulfurization, (b) wherein the copper oxides are provided to the molten bath in stoichiometric or in excess of up to about 20 wt % of stoichiometric ratios, (c) agitating the molten bath, (d) thereby oxidizing the sulfide concentrate in a one step to produce: (1) molten blister copper, (2) iron oxide-containing slag, and (3) highly concentrated $SO_2$ off gas, (e) removing at least a portion of said molten blister copper from step (c) and contacting it with oxygen to produce copper oxide, (f) recirculating the copper oxide produced in step (e) to the molten bath of step (a), (g) removing at least a portion of the molten blister copper produced in step (d) for further refining or processing.

2. The method of claim 1, wherein the iron oxide-containing slag is further treated with carbon in the form of coal, natural gas, coke or a combination thereof to produce copper metal.

3. The method of claim 1, wherein the concentrated $SO_2$ off gas is provided to one or more of plants selected from the group consisting of a handling plant for sulfuric acid production, a gypsum production plant, and a sulfur dioxide liquefaction plant.

4. The method of claim 3 wherein energy is produced and captured by the further step of producing sulfuric acid from the rich $SO_2$ off gas from the smelting furnace.

5. The method of claim 4, wherein reoxidation of copper to copper oxides produces energy.

6. The method of claim 1 wherein the copper oxides provided in step (a) is CuO, $Cu_2O$ or a combination thereof.

7. The method of claim 6, wherein the stoichiometry of the reaction in the smelting furnace, in which the copper feed is converted to metallic copper, a slag, and an $SO_2$ off gas is defined as the amount of CuO required to completely (1) convert the copper contained in the feed to metallic copper, (2) oxidize any iron in the feed to FeO and/or $Fe_2O_3$, which report to the slag, and (3) oxidize any sulfur in the feed to $SO_2$ and substantially maintained in providing the sulfide and oxide.

8. The method of claim 6, wherein a flux material is provided and the copper concentrate, flux and the one or more copper oxides are fed into the molten slag where they react before separating to molten slag and blister copper.

9. The method of claim 1, wherein the temperature of the smelting furnace, wherein the oxidation of the copper concentrate is performed, is 1100-1400° C.

10. The method of claim 1 wherein a chemically inert gas is injected into the molten bath.

11. The method of claim 10, wherein the chemically inert gas is $N_2$.

12. The method of claim 10, wherein the furnace for the oxidation of the copper concentrate is an electric furnace with tuyères to blow the chemically inert gas into the molten bath.

13. The method of claim 1, wherein the content of $SO_2$ produced is 20-100 wt %.

14. The method of claim 1, wherein the sulfur content in the molten copper is reduced to below 1%, and the oxygen content in the molten copper is reduced to below 0.6 wt %.

15. The method of claim 14, wherein the sulfur content in the molten copper is reduced to below 0.9%, and the iron content in the molten copper is reduced to below 0.002 wt %.

16. The method of claim 1, wherein the residual copper content in the treated bath is below 0.5 wt % and the total copper recovery from the bath exceeds 92%.

17. The method of claim 1, wherein copper is reoxidized with air to produce the required amount of copper oxide for use in the smelting-desulfurization step.

18. The method of claim 17, wherein at least 80 wt % CuO relative to capacity of the copper to be reoxidized is produced.

19. The method of claim 1, wherein molten copper is atomized to molten droplets and reoxidized in a vertical, flash or downer furnace.

20. The method of claim 1 wherein the blister copper is further oxidized in a reoxidation furnace to produce copper oxide(s).

21. The method of claim 1 wherein the one or more copper oxides are provided from one or more external sources selected from the group consisting of pigments, spent catalysts, battery components, sulfates, carbonates, hydroxides and one or more of the minerals such as malachite, azurite, cuprite, chrysocolla, blue vitriol, antlerite, brochantite.

22. A method for production of copper comprising the steps of:

(a) feeding copper sulfide concentrate, CuO, and gaseous oxygen or air into a molten bath of a furnace, wherein the total of the CuO and the gaseous oxygen, combined, are fed in stoichiometric ratio or in slight excess of up to about 20 wt % of stoichiometric ratios; wherein the content of the total CuO is 96.6-100 wt % and content of the gaseous oxygen is 3.4 to 0 wt %, (b) agitating the molten bath operation to produce (1) molten blister copper, (2) iron oxide slag, and (3) highly concentrated $SO_2$ off gas, (c) treating the blister copper to reduce the iron content and oxidize residual sulfur, and prepare it for either electrolysis or reoxidation.

23. The method of claim 22, wherein the iron oxide slag is treated in a slag treatment furnace by carbon in the form of coal, natural gas, coke or a combination thereof reduction and wherein the molten blister copper is provided to an anode furnace.

24. The method of claim 23, wherein the slag is treated to recover copper.

25. The method of claim 24, wherein the furnace used to treat the slag is an electric furnace.

26. The method of claim 24, wherein the residual copper content in the treated slag is reduced below 0.5 wt % and the total copper recovery from the slag exceeds 92 wt %.

27. The method of claim 22, wherein the method for feeding the copper concentrate, flux and CuO is such that both materials are fed into the molten slag where they react before separating to molten slag and blister copper.

28. The method of claim 22, wherein the temperature of the smelting furnace wherein the oxidation of the copper concentrate is performed is 1100-1400° C.

29. The method of claim 22, wherein the air is injected into the molten slag formed during the oxidation of the copper concentrate to promote chemical reaction.

30. The method of claim 22, wherein a chemically inert gas is injected into the molten slag formed during the oxidation of the copper concentrate to promote chemical reaction.

31. The method of claim 30, wherein the chemically inert gas is $N_2$.

32. The method of claim 30, wherein the furnace for the oxidation of the copper concentrate is an electric furnace with tuyères to blow the chemically inert gas into the molten slag.

33. The method of claim 22, wherein the sulfur content in the molten copper is reduced to below 1%, the iron content in the molten copper is reduced to below 0.3% and the oxygen content in the molten copper is below 0.6 wt %.

34. The method of claim 22, wherein the sulfur content in the molten copper is reduced to below 0.9% and the iron content in the molten copper is reduced to below 0.002 wt %.

35. The method of claim 22, wherein copper is reoxidized with air to produce the required amount of CuO for use in the smelting-desulfurization step.

36. The method of claim 35, wherein at least 80 wt % CuO relative to capacity of the copper to be reoxidized is produced.

37. The method of claim 35, wherein molten copper is atomized to molten droplets and reoxidized in a vertical, flash or downer furnace.

* * * * *